US009797121B2

(12) United States Patent
Francis

(10) Patent No.: US 9,797,121 B2
(45) Date of Patent: Oct. 24, 2017

(54) SYSTEMS AND METHODS FOR UNCLOGGING A DRAIN

(71) Applicant: Joe Francis, Ruston, WA (US)

(72) Inventor: Joe Francis, Ruston, WA (US)

( * ) Notice: Subject to any disclaimer, the term of this patent is extended or adjusted under 35 U.S.C. 154(b) by 165 days.

(21) Appl. No.: 14/622,778

(22) Filed: Feb. 13, 2015

(65) Prior Publication Data

US 2016/0237667 A1 Aug. 18, 2016

(51) Int. Cl.
*E03C 1/302* (2006.01)
*E03D 9/10* (2006.01)

(52) U.S. Cl.
CPC ..... *E03C 1/302* (2013.01); *E03D 9/10* (2013.01)

(58) Field of Classification Search
CPC ..... E03C 1/30; E03C 1/302; E03D 9/10
USPC ..... 4/255.01
See application file for complete search history.

(56) References Cited

U.S. PATENT DOCUMENTS 2,454,333 A * 11/1948 Moon ..... E03C 1/23 251/129.01
3,652,054 A * 3/1972 Layton ..... F16K 31/0655 251/65
9,518,383 B2 * 12/2016 Lesmeister ..... A47K 1/14
2013/0312177 A1 * 11/2013 Tong ..... E03C 1/2302 4/689
2013/0340793 A1 * 12/2013 Lund ..... B08B 9/0436 134/22.11
2015/0013056 A1 * 1/2015 Lee ..... E03D 3/10 4/348

* cited by examiner

*Primary Examiner* — J. Casimer Jacyna
(74) *Attorney, Agent, or Firm* — Michelle E. Carey; Telekta Law, P.S.

(57) ABSTRACT

A system and method for unclogging a drain involving at least one internal member and at least one external member. At least one member is ferromagnetic, and at least one member is a magnet. External members may have handles. Internal members are disposed inside a pipe and external members are disposed outside a pipe. When an external member is moved, the magnetic force between the internal and external members causes the internal member to move. Internal members can be disposed such that they cause a clog to move further into the drain system. Internal members can also be disposed such that they are below the clog when it forms, allowing the internal members to move the clog out of the pipe system, into the sink, toilet, or other basin. Safety members can be disposed below the internal members to prevent loss of internal members into pipe system.

17 Claims, 7 Drawing Sheets

SYSTEMS AND METHODS FOR UNCLOGGING A DRAIN

SUMMARY

This invention relates generally to baths, closets, sinks, and spittoons, and, more specifically, to systems and methods for unclogging a drain.

To date, means for unclogging a drain have involved harsh chemicals or mechanical manipulation, often by plunging or a "drain snake", which can cause splashing and contact with the contents of the clog. Often these contents are unsanitary. Sometimes the clog is severe that it results in expensive plumbing costs for professional service. Moreover, sometimes the clog is severe enough that it simply cannot be moved down the drain and must be pulled back toward the inlet of the drain.

The present invention is a system for unclogging a drain wherein the unclogging device is removably disposed inside the drain and can remain there during normal use of the drain. The system allows the user to manipulate the unclogging device from the outside of the drain, reducing exposure to contaminated material and reducing the need for specialized tools or harsh chemicals. Moreover, the drain inlet can be covered, such as by a toilet bowl lid, while the device is in using, further reducing the exposure to unsanitary conditions.

In one embodiment, the system for unclogging a drain may be comprised of at least one internal magnetic member and at least one external magnetic member, wherein the at least one external magnetic member is disposed such that it exerts a magnetic force on the at least one internal magnetic member. In some embodiments, the at least one internal magnetic member is disposed inside a drain. In some embodiments, the system for unclogging a drain may include a safety magnetic member disposed outside the drain below the at least one external magnetic member.

In some embodiments, the at least one external magnetic member may be a permanent magnet. In another embodiment, the at least one internal magnetic member may be a permanent magnet. In some embodiments, the at least one internal magnetic member and the at least one external magnetic member are dipole magnets. In one embodiment, the at least one internal magnetic member may be coated in a noncorrosive protective material. In another embodiment, the at least one external magnetic member may be coated in a non-abrasive material.

In some embodiments, the at least one internal magnetic member may be further comprised of at least one drain cleaning tool and capable of removably coupling with the at least one internal magnetic member. In one embodiment, the at least one drain cleaning tool may be non-magnetically coupleable with the at least one internal magnetic member. In some embodiments, the internal magnetic member may be further comprised of a rod disposed in a side of the internal magnetic member such that it protrudes across the width of the drain. In some embodiments, the internal magnetic member may be further comprised of a rod disposed in a side of the internal magnetic member such that it protrudes parallel to a wall of the drain.

In some embodiments, the external magnetic member may be further comprised of a handle coupled with the external magnetic member such that the external magnetic member is cable of being moved along the drain.

In some embodiments, the system for unclogging a drain may be comprised of at least one internal magnetic member disposed inside a drain and at least one external magnetic member, wherein the at least one external magnetic member is disposed outside the drain such that it exerts a magnetic force on the at least one internal magnetic member.

In some embodiments, the system for unclogging a drain may be comprised of at least one internal magnetic member disposed inside a toilet and at least one external magnetic member, wherein the at least one external magnetic member is disposed outside the toilet such that it exerts a magnetic force on the at least one internal magnetic member. In some embodiments, the at least one internal magnetic member may be disposed inside the toilet bowl. In some embodiments, the at least one internal magnetic member may be disposed inside the toilet drain line. In some embodiments, the at least one internal magnetic member disposed inside the toilet drain line is located near the outlet of the toilet drain line. In some embodiments, the at least one internal magnetic member disposed inside the toilet drain line may be located near the outlet of the toilet drain line and capable of being magnetically moved toward the inlet of the drain line by following the motion of the at least one external magnetic member.

The system for unclogging a drain is essentially comprised of means for physically disrupting a clog and means for magnetically controlling the means for physically disrupting a clog.

In addition to the foregoing, various other systems and/or product embodiments are set forth and described in the teachings such as the text (e.g., claims, drawings and/or the detailed description) and/or drawings of the present disclosure.

The foregoing is a summary and thus contains, by necessity, simplifications, generalizations and omissions of detail; consequently, those skilled in the art will appreciate that the summary is illustrative only and is NOT intended to be in any way limiting. Other aspects, embodiments, features and advantages of the device and/or processes and/or other subject matter described herein will become apparent in the teachings set forth herein.

BRIEF DESCRIPTION OF THE DRAWINGS

Certain embodiments of the present invention are described in detail below with reference to the following drawings.

DETAILED DESCRIPTION

This invention relates generally to baths, closets, sinks, and spittoons, and, more specifically, to systems and methods for unclogging a drain. Specific details of certain embodiments of the invention are set forth in the following description and in FIGS. 1-7 to provide a thorough understanding of such embodiments. The present invention may have additional embodiments, may be practiced without one or more of the details described for any particular described embodiment, or may have any detail described for one particular embodiment practiced with any other detail described for another embodiment.

Importantly, a grouping of inventive aspects in any particular "embodiment" within this detailed description, and/or a grouping of limitations in the claims presented herein, is not intended to be a limiting disclosure of those particular aspects and/or limitations to that particular embodiment and/or claim. The inventive entity presenting this disclosure fully intends that any disclosed aspect of any embodiment in the detailed description and/or any claim limitation ever presented relative to the instant disclosure and/or any continuing application claiming priority from the instant application (e.g. continuation, continuation-in-part, and/or divisional applications) may be practiced with any other disclosed aspect of any embodiment in the detailed description and/or any claim limitation. Claimed combinations which draw from different embodiments and/or originally-presented claims are fully within the possession of the inventive entity at the time the instant disclosure is being filed. Any future claim comprising any combination of limitations, each such limitation being herein disclosed and therefore having support in the original claims or in the specification as originally filed (or that of any continuing application claiming priority from the instant application), is possessed by the inventive entity at present irrespective of whether such combination is described in the instant specification because all such combinations are viewed by the inventive entity as currently operable without undue experimentation given the disclosure herein and therefore that any such future claim would not represent new matter.

The system for unclogging a drain is comprised essentially of an internal member and an external member, wherein the external member exerts a magnetic force on the internal member.

Figure 1:
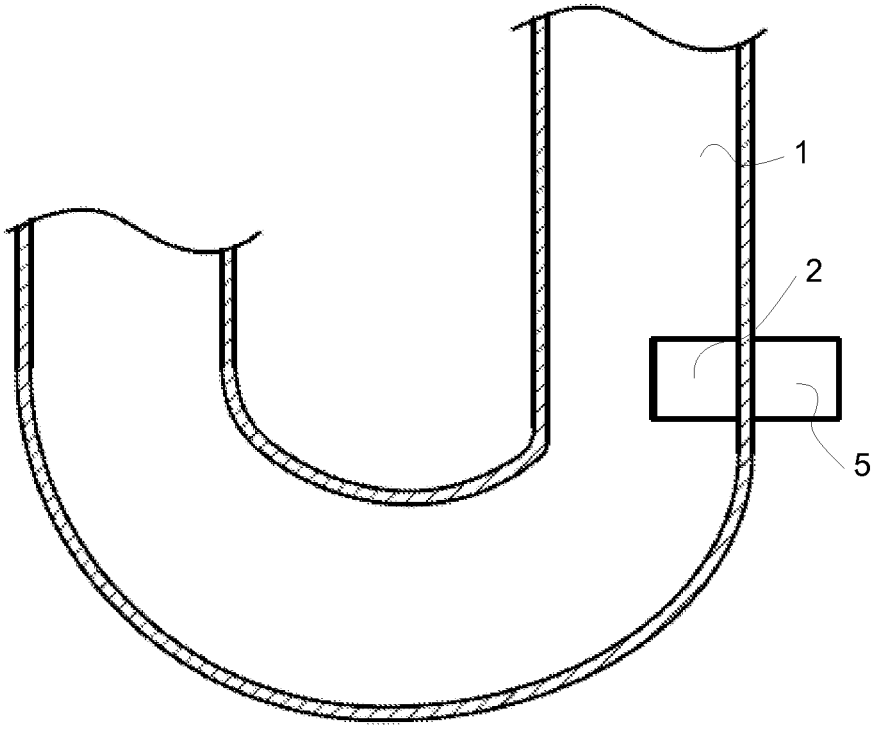
FIG. 1 is an environmental view of the system for unclogging a drain as applied to a u-bend in a pipe.

FIG. 1 shows one embodiment of the present invention as disposed in a u-bend in a p-pipe, otherwise known as a drain trap. The present invention relies on magnetic force to drive a clog out of a drain 1. In one embodiment, an internal member 2 is disposed inside a drain 1 before a clog forms. In some embodiments, internal member 2 is small enough to prevent a clog from forming on the member. In this circumstance, small means less than one half the diameter of the drain in which it is disposed. In some embodiments, internal member 2 is shaped such that liquid and debris flow easily over it. In these embodiments, internal member 2 may be cylindrical, elliptical, spherical, or of a particularly hydrodynamic shape. In some embodiments, internal member 2 may be comprised of a ferromagnetic material, such as iron or steel. In some embodiments, internal member 2 may be comprised of a magnet. In some embodiments, internal member 2 may be covered in a coating of some sort, such as a noncorrosive coating or a nonabrasive coating.

FIG. 1 also depicts external member 5. In some embodiments, external member 5 is disposed outside a drain 1, opposite internal member 2. In some embodiments, external member 5 is disposed on an external drain wall. In a preferred embodiment, external member 5 is of a shape and size such that it is inconspicuous yet maneuverable, but external member 5 can be any shape or size without altering the function of the system, so long as it exerts a sufficient force on internal member 2. In some embodiments, external member 5 may be comprised of a ferromagnetic material, such as iron or steel. In some embodiments, external member 5 may be comprised of a magnet. In some embodiments, external member 5 may be covered in a coating, such as a noncorrosive or nonabrasive coating.

In some embodiments, internal member 2 and external member 5 may be comprised of the same material. In other embodiments, internal member 2 may be ferromagnetic while external member 5 is a magnet. In yet another embodiment, internal member 2 may be magnetic while external member 5 is ferromagnetic. In some embodiments, the magnetic member or members may be permanent magnets. In some embodiments, the magnetic member or members may be electromagnets. In some embodiments, the magnetic member or members may be dipole magnets, allowing the external member to rotate or flip the internal member, for example.

Figure 2:
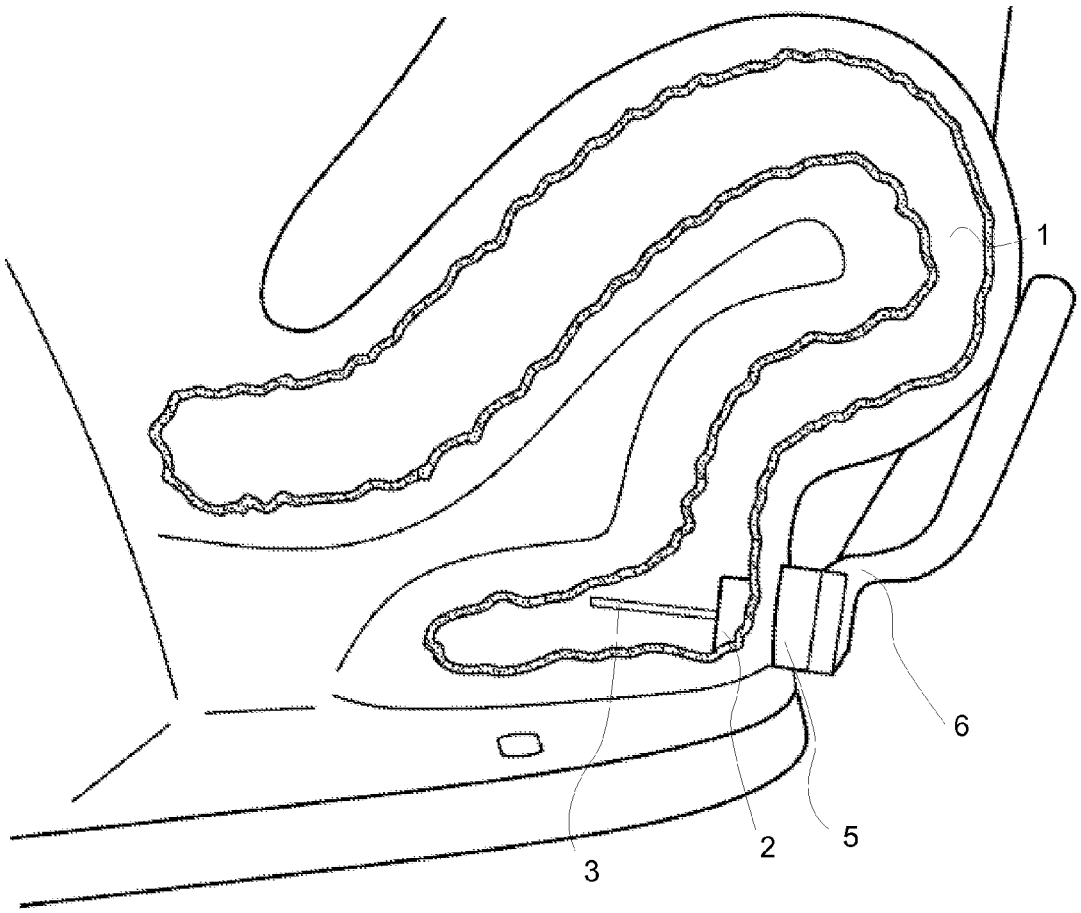
FIG. 2 is an environmental view of the system for unclogging a drain showing one embodiment of an internal member and one embodiment of an external member.

FIG. 2 shows one embodiment of the invention as disposed in a toilet drain. In some embodiments, internal member 2 may be comprised of a tool 3. In some embodiments, tool 3 may be a rod. In some embodiments, the rod may be flexible. In some embodiments, the rod may be rigid. In some embodiments, tool 3 may run parallel to the wall of the drain 1. In other embodiments, tool 3 may extend across at least part of the diameter of drain 1.

In some embodiments, external member 5 may have a handle 6. In some embodiments, handle 6 may include antibacterial materials. In some embodiments, handle 6 may be comprised of a rigid material, such as metal or plastic. In some embodiments, handle 6 may be comprised of a more flexible material, such as rubber. In some embodiments, handle 6 may have a long grip length, wherein "long" means six inches or longer. In some embodiments, handle 6 may have a short grip length, wherein "short" means fewer than six inches in length. In some embodiments, handle 6 may include a hinge. In some embodiments, handle 6 may be configured to allow easy manipulation of a dipole magnet, such as full or partial rotation. The purpose of handle 6 is ease of use of external member 5, and as such, the handle may be comprised of any number of materials without altering the function of the handle. Furthermore, handle 6 may be circular, elongated, rectangular, or any number of shapes without altering the function of the handle.

In some embodiments, handle 6 may be configured to flip external member 5. That is to say, instead of rotating external member 5, handle 6 may be configured to flip the external member longitudinally over an end. In response, internal member 2 would be made to flip longitudinally over an end. In a further embodiment, internal member 2 may have a tool 3 disposed between the internal member and the internal wall of drain 1. When external member 5 is flipped, causing internal member 2 to flip, tool 3 may be released or deployed, at which point it would be used to break up or remove debris causing a clog. In some embodiments, tool 3 may be spring loaded, such that the tool deploys when the internal member is flipped. In other embodiments, tool 3 may be flattened between internal member 2 and the internal wall of drain 1, such that it expands when the internal member is flipped. In another embodiment, tool 3 may be flexibly disposed between internal member 2 and the internal wall of drain 1, such that it releases easily when the internal member is flipped.

Figure 3:
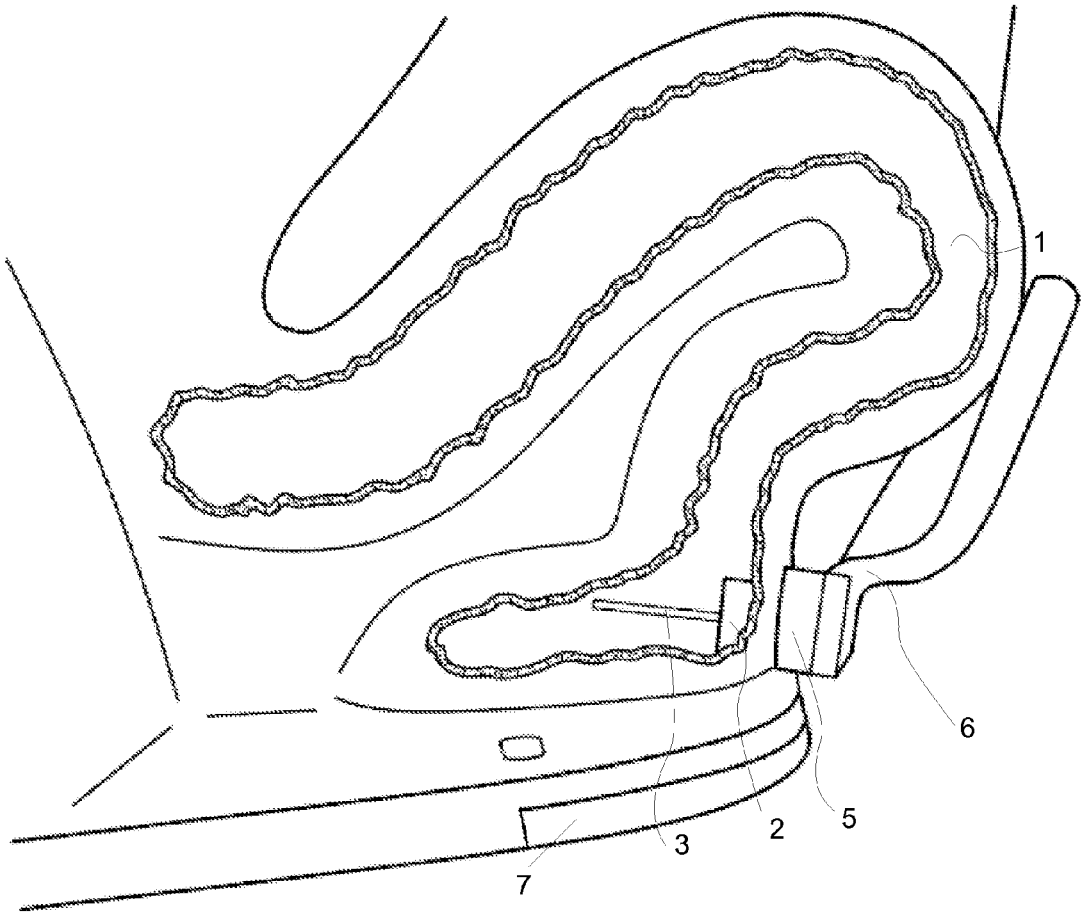
FIG. 3 is an environmental view of the system for unclogging a drain showing one embodiment of an internal member, one embodiment of an external member, and one embodiment of the safety member.

FIG. 3 depicts one embodiment of the invention as disposed in a toilet drain. In this embodiment, safety member 7 is disposed below internal member 2 and external member 5. In some embodiments, safety member 7 may be used to prevent loss of internal member 2 in the event that external member 5 is pulled from the drain, or in any other circumstance under which the magnetic force between internal member 2 and external member 5 is weakened or lost. In these embodiments, safety member 7 may exert a magnetic force on internal member 2, preventing internal member 2 from being lost down the drain. In some embodiments, safety member 7 may be ferromagnetic, such as iron or steel. In other embodiments, safety member 7 may be magnetic, such as a permanent magnet or electromagnet. In some embodiments, safety member 7 may exert a magnetic force on internal member 2 that is greater than the force exerted by external member 5. In some embodiments, safety member 7 may wrap around a drain. In some embodiments, safety member 7 may be disposed at the lowest accessible point of the drain. The shape and disposition of safety member 7 may vary with application, and as such, safety member 7 may be any number of shapes or sizes without altering the function of safety member 7.

When the system is disposed as in FIGS. 1-3, the method of use involves moving external member 5 along the drain, generally toward the drain inlet, such as the toilet bowl or the sink basin, for example. This draws internal member 2 toward a wider opening, disrupting the clog and allowing for access to and removal of that material. In some embodiments, external member 5 may be moved to and fro, running internal member 2, and, in some embodiments, tool 3 into the clog repeatedly in order to break it up.

Figure 4A:
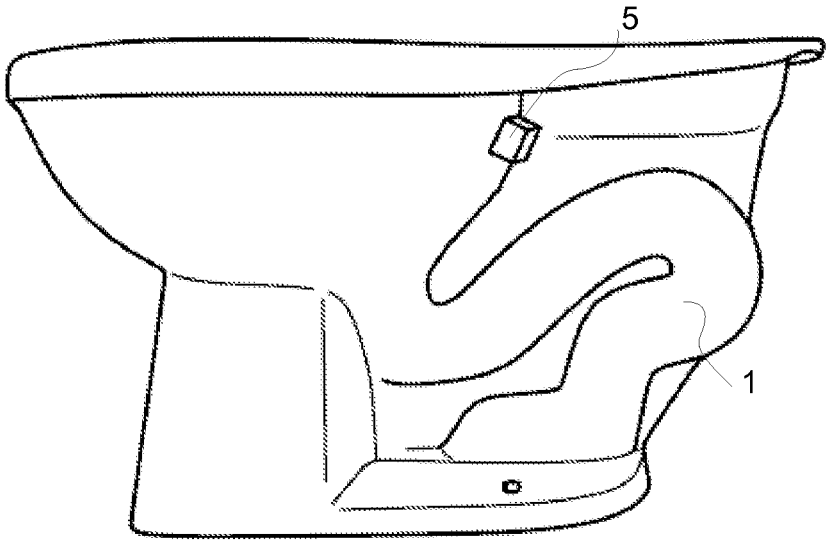
FIG. 4*a* is an environmental view of an alternative disposition of the external member.
Figure 4B:
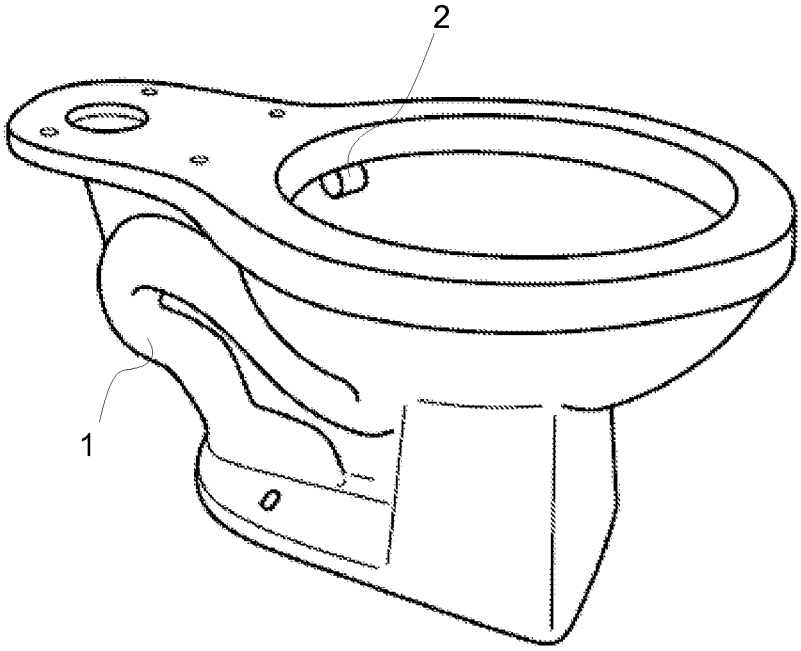
FIG. 4*b* is an environmental view of an alternative disposition of the internal member.

FIGS. 4*a* and 4*b* show more alternative embodiments of the system for unclogging a drain. In FIG. 4*a*, the external member 5 can be seen outside the bowl of a toilet, rather than inside drain 1. In FIG. 4*b*, the internal member 2 can be seen inside the bowl of a toilet. In this embodiment, the method switches from drawing the clog toward the opening to disrupting the clog. When a clog is formed in drain 1, external member 5 is moved down the drain toward the clog, magnetically moving internal member 2 toward the drain. Because internal member 2 is able to disrupt small portions of the clog, the clog may clear with less force and less effort than required with a drain snake or plunger, for example.

Figure 5A:
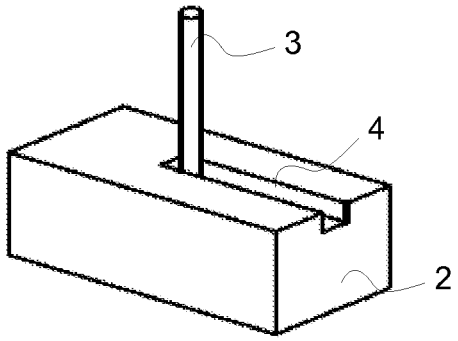
FIG. 5*a* is one exemplary embodiment of the internal member with rod deployed.
Figure 5B:
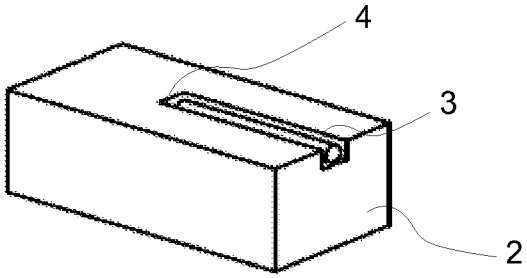
FIG. 5*b* is one exemplary embodiment of the internal member with rod retracted.
Figure 5C:
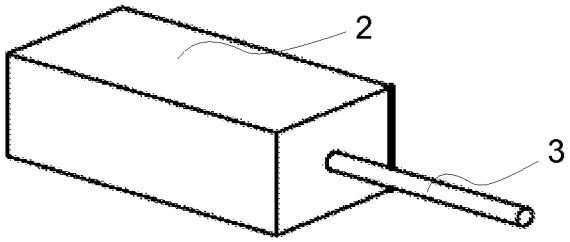
FIG. 5*c* is one exemplary embodiment of the internal member with a fixed rod in an alternate location.

FIGS. 5*a* and 5*b* show internal member 2 with tool 3, wherein tool 3 has taken on the shape of a rod. In this embodiment, tool 3 is retractable into recess 4. When inactive, tool 3 is retracted into recess 4. When moved by external member 5, tool 3 deploys and is used to disrupt any material that may be clogging the toilet. In some embodiments, tool 3 may be deployed by the motion of the liquid over internal member 2. In some embodiments, tool 3 may be deployed by a trigger in external member 5 or handle 6. In some embodiments, tool 3 may be fixed, and recess 4 eliminated, such that tool 3 protrudes into the diameter of the drain. FIG. 5*c* shows another alternative embodiment, wherein tool 3 is deployed along the longitudinal axis of internal member 2. In this embodiment, tool 3 may be used to disrupt a small portion of the clog, allowing for liquid to flow again. When liquid begins to flow, the force of the flow may disrupt the remaining debris causing the clog and drain any backup that may exist.

Figure 6A:
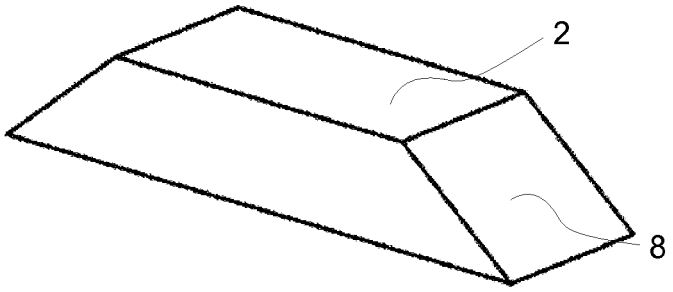
FIG. 6*a* is a different exemplary embodiment of the internal member.
Figure 6B:
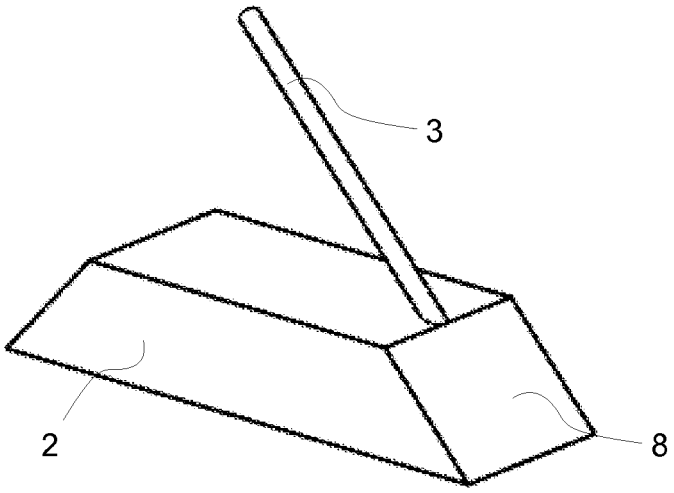
FIG. 6*b* is a different exemplary embodiment of the internal member with a fixed rod.

FIGS. 6*a* and 6*b* show another alternative embodiment of internal member 2. In this embodiment, internal member 2 is specifically designed to cause as little disruption to the normal operation of the drain as possible. Angled face 8 on both longitudinal ends of internal magnet 2 allows liquid and debris to flow easily over internal member 2. Moreover, this particular embodiment allows internal member 2 to slide between the internal wall of drain 1 and the debris causing the clog, creating a space which allows for liquid to pass. Once liquid is flowing, the clogged basin can drain and the force of the flowing liquid may be sufficient to remove the remainder of the debris. FIG. 6*b* shows this particular embodiment with tool 3, wherein tool 3 is at an angle to the wall of drain 1. When internal member 2 is moved into the clog, tool 3 may create additional disruption by either moving or breaking apart whatever has caused the clog.

Figure 7A:
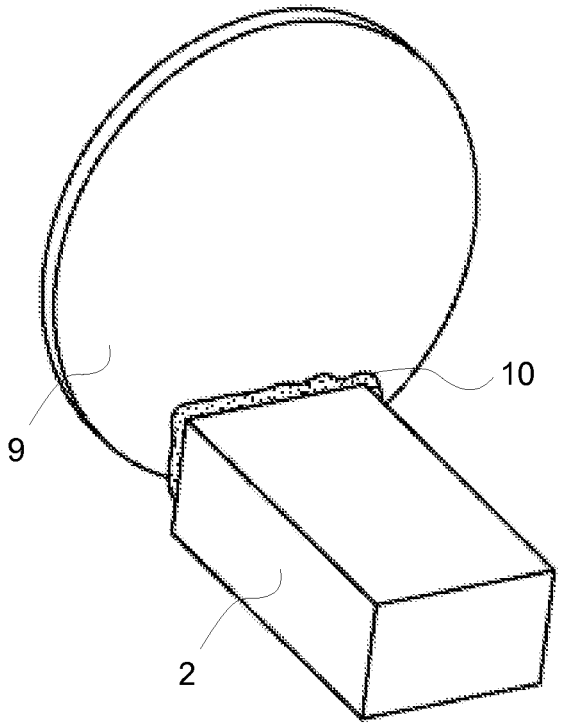
FIG. 7*a* is another alternate embodiment of the internal member, this embodiment having a deployed disk for collecting debris from the drain.
Figure 7B:
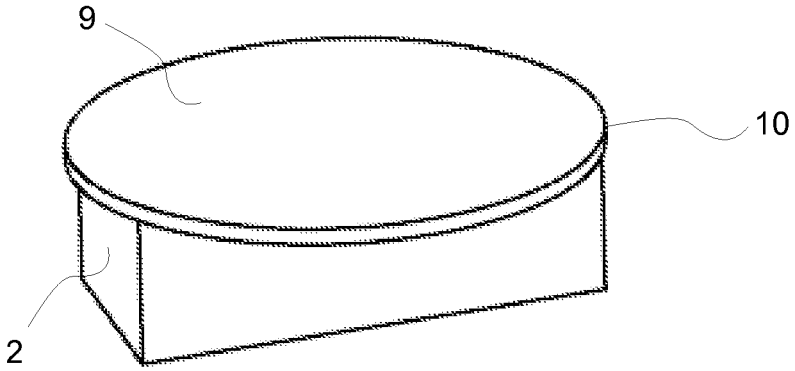
FIG. 7*b* is an alternate embodiment of the internal member showing the disk as retracted.

FIGS. 7*a* and 7*b* show another alternative embodiment of internal member 2. In this embodiment, internal member 2 is joined with disk 9 by hinge 10. During normal operation, disk 9 is retracted against internal member 2. When deployed, disk 9 is perpendicular to the longitudinal surface of internal member 2. An exemplary method of use is for clearing the water trap in a toilet. When debris ends up on the surface of the water in the water trap, internal member 2 can be moved by external member 5 to a location above the surface of the water in the water trap. Disk 9 is retracted, kept against the surface of internal member 2 by the force of the water. When internal member 2 is moved above the surface of the water and then back onto the surface, the surface tension of the water and any debris thereon cause disk 9 to deploy into the open position. Internal member 2 can then be moved back toward the drain inlet or, in the case of a toilet, the toilet bowl, bringing any debris with it. This is particularly useful when non-degradable material gets into the drain, such as toys, clothing items, or other items such as lip balms or lighters, particularly when the material is buoyant.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of this subject matter described herein. Furthermore, it is to be understood that the invention is defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an"

limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.).

While preferred and alternative embodiments of the invention have been illustrated and described, as noted above, many changes can be made without departing from the spirit and scope of the invention. Accordingly, the scope of the invention is not limited by the disclosure of these preferred and alternate embodiments. Instead, the invention should be determined entirely by reference to the claims that follow.

What is claimed is:

1. A system for unclogging a drain comprising:

at least one internal magnetic member, wherein the at least one internal magnetic member is configured to be disposed inside a drain;

at least one external magnetic member, wherein the at least one external magnetic member is configured to be disposed outside the drain such that it exerts a magnetic force on the at least one internal magnetic member; and at least one safety magnetic member, wherein the at least one safety magnetic member is configured to be disposed outside the drain below the at least one external magnetic member.

2. The system for unclogging a drain as in claim 1, wherein the at least one external magnetic member is a permanent magnet.

3. The system for unclogging a drain as in claim 1, wherein the at least one internal magnetic member is a permanent magnet.

4. The system for unclogging a drain as in claim 1, wherein the at least one internal magnetic member is coated in a noncorrosive protective material.

5. The system for unclogging a drain as in claim 1, wherein the at least one external magnetic member is coated in a non-abrasive material.

6. The system for unclogging a drain as in claim 1, wherein the at least one internal magnetic member and the at least one external magnetic member are dipole magnets.

7. The system for unclogging a drain as in claim 1, wherein the at least one internal magnetic member further comprises:

at least one drain cleaning tool coupleable with the at least one internal magnet.

8. The system for unclogging a drain as in claim 7, wherein the at least one drain cleaning tool is non-magnetically coupleable with the at least one internal magnetic member.

9. The system for unclogging a drain as in claim 1, wherein the at least one internal magnetic member further comprises:

at least one drain cleaning tool; and a receiving channel, the receiving channel being capable of removably coupling with the at least one internal magnetic member.

10. The system for unclogging a drain as in claim 1, wherein the internal magnetic member further comprises:

a rod disposed in a side of the internal magnetic member such that it protrudes parallel to a wall of the drain.

11. The system for unclogging a drain as in claim 1, wherein the external magnetic member further comprises:

a handle coupled with the external magnetic member.

12. A system for unclogging a drain comprising:

at least one internal magnetic member, wherein the at least one internal magnetic member is configured to be disposed inside a drain;

at least one external magnetic member, wherein the at least one external magnetic member is configured to be disposed outside the drain such that it exerts a magnetic force on the at least one internal magnetic member; and a rod disposed in a side of the internal magnetic member such that it protrudes across the width of the drain.

13. A system for unclogging a drain, comprising:

at least one internal magnetic member, wherein the at least one internal magnetic member is configured to be disposed inside a toilet;

at least one external magnetic member, wherein the at least one external magnetic member is configured to be disposed outside the toilet such that it exerts a magnetic force on the at least one internal magnetic member;

a rod disposed in a side of the internal magnetic member such that it protrudes across the width of the drain; and at least one safety magnetic member, wherein the at least one safety magnetic member is configured to be disposed outside the drain below the at least one external magnetic member.

14. The system for unclogging a drain as in claim 13, wherein the at least one internal magnetic member is configured to be disposed inside a toilet bowl.

15. The system for unclogging a drain as in claim 13, wherein the at least one internal magnetic member is configured to be disposed inside a toilet drain line.

16. The system for unclogging a drain as in claim 13, wherein the at least one internal magnetic member configured to be disposed inside a toilet drain line is located near the outlet of the toilet drain line.

17. The system for unclogging a drain as in claim 16, wherein the at least one internal magnetic member configured to be disposed inside the toilet drain line is located near an outlet of the toilet drain line and capable of being magnetically moved toward an inlet of the drain line by following the motion of the at least one external magnetic member.

* * * * *